US009085064B2

(12) United States Patent
Cooper

(10) Patent No.: US 9,085,064 B2
(45) Date of Patent: Jul. 21, 2015

(54) SYSTEM FOR DISPENSING ABRASIVES INTO A GAS STREAM FOR CLEANING PIPE INTERIORS

(75) Inventor: Randall J. Cooper, Bracebridge (CA)

(73) Assignee: ENVIROLOGICS ENGINEERING INC., Ontario (CA)

( * ) Notice: Subject to any disclaimer, the term of this patent is extended or adjusted under 35 U.S.C. 154(b) by 680 days.

(21) Appl. No.: 12/923,201

(22) Filed: Sep. 9, 2010

(65) Prior Publication Data

US 2012/0064806 A1 Mar. 15, 2012

(51) Int. Cl.

| | |
|---|---|
| ***B24C 1/08*** | (2006.01) |
| ***B24C 3/06*** | (2006.01) |
| ***B24C 3/32*** | (2006.01) |
| ***B24C 7/00*** | (2006.01) |

(52) U.S. Cl.

CPC ..... *B24C 7/0046* (2013.01); *B24C 1/08* (2013.01); *B24C 3/06* (2013.01); *B24C 3/32* (2013.01); *B24C 3/327* (2013.01); *B24C 7/00* (2013.01)

(58) Field of Classification Search

CPC ..... B08B 9/032; B08B 9/04; B24B 33/02; B24C 1/08; B24C 1/086; B24C 3/06; B24C 3/32; B24C 3/325; B24C 3/327; B24C 7/0046; B24C 7/0053

USPC ..... 451/38, 39, 40, 61, 76, 91, 92, 99, 101; 134/8, 21.1, 22.1, 22.11, 22.12, 22.13

See application file for complete search history.

(56) References Cited

U.S. PATENT DOCUMENTS

| | | | | |
|---|---|---|---|---|
| 3,640,023 | A * | 2/1972 | Field et al. | 451/88 |
| 3,798,841 | A * | 3/1974 | Eppler | 451/99 |
| 3,914,815 | A * | 10/1975 | Kobayashi | 15/3.5 |
| 4,081,930 | A * | 4/1978 | Jones | 451/38 |
| 4,818,298 | A * | 4/1989 | Shishkin et al. | 134/22.11 |
| 4,993,200 | A * | 2/1991 | Morioka et al. | 451/88 |
| 5,046,289 | A * | 9/1991 | Bengel et al. | 451/76 |
| 5,239,786 | A * | 8/1993 | Carpenter | 451/38 |
| 5,588,901 | A * | 12/1996 | Rubey et al. | 451/99 |
| 6,739,950 | B1 * | 5/2004 | Kruse | 451/37 |
| 7,041,176 | B2 * | 5/2006 | Kruse | 134/8 |
| 7,160,574 | B1 * | 1/2007 | Gillanders et al. | 427/238 |

(Continued)

FOREIGN PATENT DOCUMENTS

| | | | |
|---|---|---|---|
| CA | 2707023 | A1 | 6/2009 |
| CA | 2735784 | A1 | 11/2009 |
| GB | 1025489 | A | 4/1966 |

*Primary Examiner* — Eileen Morgan

(74) *Attorney, Agent, or Firm* — Frank Liebenow; Larson & Larson, P.A.

(57) ABSTRACT

A system and method for dispensing abrasive particulate material into a stream of air or gas for introduction into a pipe for the purpose of cleaning the pipe and preparing the inner surface for coating or lining. The system comprises an air blower coupled to the pipe, and generates the stream of air or gas, and a three component feed assembly for dispensing the abrasive particulate material. The feed assembly operates at atmospheric pressure and is in fluid communication with each of the pipe and the air blower, and is used to meter the abrasive particulate material into the stream of gas for introduction into the pipe. The system further comprises a shut-off valve that is in fluid communication with the feed assembly, the air blower and the pipe and is cycled to isolate the feed assembly from the air blower during pipe drying and maintenance operations.

10 Claims, 3 Drawing Sheets

(56) References Cited

U.S. PATENT DOCUMENTS

| | | | | |
|---|---|---|---|---|
| 8,398,460 | B2 * | 3/2013 | Christopher | 451/38 |
| 8,403,726 | B2 * | 3/2013 | Leben | 451/38 |
| 2003/0199232 | A1 | 10/2003 | Rivir et al. | |
| 2003/0224704 | A1 * | 12/2003 | Shank | 451/38 |
| 2004/0106366 | A1 | 6/2004 | Robinson et al. | |
| 2004/0132387 | A1 * | 7/2004 | Kruse | 451/51 |
| 2009/0270016 | A1 * | 10/2009 | Christopher | 451/39 |
| 2011/0065363 | A1 * | 3/2011 | Kuroiwa et al. | 451/38 |

* cited by examiner

SYSTEM FOR DISPENSING ABRASIVES INTO A GAS STREAM FOR CLEANING PIPE INTERIORS

The present invention relates to a system and method for dispensing abrasive particulate material into a stream of air or gas that is introduced into a pipe for the purpose of cleaning the internal pipe walls, as well as preparing surfaces of the internal pipe circumference for the later application of an immediate, protective coating or lining.

BACKGROUND OF THE INVENTION

It is well known that contaminants and corrosion products, such as tubercles, rust, scale and the like, can form inside metallic water mains and pipes as a result of corrosion, and can form layers, which can build up over time to form lumps and mounds, masking areas of internal metal loss.

These occlusive build ups can severely reduce the internal bore of pipes, leading to reduced flow capacity and a necessary increase in pumping pressure to maintain a sufficient supply of water or other fluid flowing through the pipe. Moreover, the build-up of corrosion products can adversely affect the quality of the fluid flowing in the pipe, creating problems such as "red water" in drinking water systems.

The use of abrasives in a flowing air or gas stream for pipe cleaning to remove the above-noted contaminants and corrosion products is well known. The generic process of "sandblasting" is a mature technology frequently used in larger-diameter, man-entry pipes for surface preparation, and the process of injecting garnet grit (beach-sand consistency) into a flowing compressed airstream has been used previously in small diameter pipes to facilitate the removal of corrosion products as well as the surface preparation of the internal pipe circumference for immediate, protective coating. In fact, the U.S. Navy used this process for numerous years to remove corrosion from the internal bore of small-diameter pipes installed on its aircraft carrier fleet, after which, the pipes were remotely coated with a protective epoxy. Recently, various combinations of gases and abrasives, such as the use of frozen gas pellets and different propellant gases, have been combined to attempt to remove contaminants and corrosion products, as well as to prepare surfaces of the internal pipe circumference for the later application of an immediate, protective coating or liner.

The process of abrasive blasting becomes more complex wherever pipeline entry is not possible by virtue of pipe diameter (too small) or location (inaccessible). The deployment of an abrasive from a single entry point, over medium/long pipe distances, requires a novel process. This process uses special equipment and produces a different surface blast pattern and outcome.

More recently, larger-sized abrasives (e.g. stones versus grit), in combination with larger air movers (compressors/blowers), have been used to clean corroded water pipes in diameter ranges of 4" through 8" in the UK. This process deploys an abrasive in a gas stream and was (again) used to remove heavy corrosion products in small diameter pipes and prepare the internal circumference for immediate protective coating.

However, these conventional systems do have drawbacks and limitations. For one thing, cleaning systems that deploy an abrasive in a gas stream, such as that described in United States Patent Application Publication No. 2009/270016 (Christopher), disclose the use of a pressurized hopper for dispensing the abrasive particulate material into the air or gas stream. Such pressurized vessels require periodic inspections, maintenance and testing to preclude deterioration and rupture that could pose a significant safety hazard. Pressurized vessels that contain rocks are potentially unsafe and are therefore typically fabricated with heavy-walled, welded steel.

Furthermore, with such pressurized vessels, when that vessel has been filled (charged) with rocks and abrasive particulate matter, and is thereafter pressurized, it is not possible to add more rock or material to the pressurized hopper without de-energizing the feed system altogether, thus slowing down the system operation.

In addition, such conventional abrasive blasting systems utilize an axial-feed screw for dispensing abrasive particulate material from the pressurized hopper into the air or gas stream. While the use of such systems provides a steady controlled rate of insertion of abrasive particulate, the operator cannot visually observe the process. As such, operators of such systems cannot visually perceive problems such as hang-ups or jamming of the abrasive media. The operator must either rely on experience or other sensory cues, or de-energize the system to investigate a feed problem.

It would, therefore, be advantageous to have an improved system and method for dispensing abrasive particulate material into a stream of air or gas that utilizes a hopper (containing the abrasive particulate material) that is open to the atmosphere (unpressurized), whereupon an operator can readily add more abrasive particulate material into the air or gas stream as required or needed, without the need to de-energize the system or shut down, thus increasing the efficiency and speed of the system in accomplishing the task.

It would be further advantageous to have an improved system and method for dispensing abrasive particulate material into a stream of air or gas that provides no pressure blow back, by virtue of using a hopper that is open to the atmosphere, and which is easily portable, lighter in weight, and safer than current pressurized screw feed system configurations.

It would also be further advantageous to have an improved system and method for dispensing abrasive particulate material into a stream of air or gas that utilizes a valve body and a sliding gate (two controls) to keep variable control of the introduction of abrasive particulate material into the hopper, rather than a feed screw, thus giving an operator better control of the dosing rate into the hopper, both mechanically and visually, and thus better control of the pipe cleaning and preparation process.

Accordingly, there is a need for an improved system and method of delivery of abrasive material into a gas stream for the purpose of cleaning, preparing and coating or lining the interior surface of in-service, small-diameter pipes. There is a further need for a pipe cleaning system which is operably able to introduce abrasive from a vessel under atmospheric conditions, rather than a pressurized vessel, whereby these abrasive materials can be introduced into a pressurized gas stream in a measured, highly-controlled and safe manner. To this end, the present invention effectively addresses these needs.

SUMMARY OF THE INVENTION

An important advantage and object of the present invention is that it provides an improved system and method for dispensing abrasive particulate material into a stream of air or gas that utilizes a hopper (containing the abrasive particulate material) that is open to the atmosphere, through use of which an operator can add more abrasive particulate material into the air or gas stream as required or needed, without the need to de-energize the system or shut down, thus increasing the speed of the system in accomplishing the task.

Another important advantage and object of the present invention is that it provides an improved system and method for dispensing abrasive particulate material into a stream of air or gas that provides no potential for pressurized abrasive blow-back, by virtue of using a hopper that is open to the atmosphere, and which is lighter in weight than the current, pressurized configurations, and therefore more flexible (portable) in use.

Another important advantage and object of the present invention is that it provides an improved system and method for dispensing abrasive particulate material into a stream of gas that utilizes a valve body and a sliding gate (two controls) to keep variable control of the introduction of abrasive particulate material into the hopper, rather than a feed screw, thus giving an operator better control of the dosing rate into the hopper, and thus the pipe to be cleaned.

According to a first broad aspect of an embodiment of the present invention, there is disclosed a system for dispensing abrasive particulate material into a stream of gas to be introduced into a pipe for cleaning an interior of the pipe, comprising an air blower coupled to the pipe, the air blower generating the stream of gas to be introduced into the pipe; a hopper for dispensing the abrasive particulate material, the hopper being constructed and arranged for operation at atmospheric pressure and constructed and arranged for connection and fluid communication with each of the pipe and the air blower, the hopper further comprising a housing having an inlet for receiving the abrasive particulate material and an outlet for delivery of the abrasive particulate material from the hopper; and valve feed means positioned within the hopper and in fluid communication with each of the pipe and the air blower for transporting the abrasive particulate material from the hopper into the stream of gas for introduction into the pipe.

According to a second broad aspect of an embodiment of the present invention, there is disclosed a method of cleaning an interior of a pipe, said method comprising providing an air or gas stream and connecting it to the pipe to be cleaned; providing a hopper at atmospheric pressure in fluid communication with each of the air or gas stream and the pipe; providing valve feed means in communication with the hopper for regulating a flow of abrasive particulate material from the hopper to the air or gas stream and the pipe; dispensing abrasive particulate material into the hopper; and selectively operating the valve feed means so as to transport the abrasive particulate material from the hopper into the air or gas stream and the pipe.

According to a third broad aspect of an embodiment of the present invention, there is disclosed a method of cleaning an interior of a pipe, said method comprising isolating the pipe from other pipe sections; providing an air or gas stream and connecting it to the pipe to be cleaned; utilizing the air or gas stream to dry out the pipe; de-energizing the air or gas stream; providing a hopper at atmospheric pressure in fluid communication with each of the air or gas stream and the pipe providing valve feed means in communication with the hopper for regulating a flow of abrasive particulate material from the hopper to the air or gas stream and the pipe; re-energizing the air or gas stream; dispensing abrasive particulate material into the hopper; and selectively operating the valve feed means so as to transport the abrasive particulate material from the hopper into the air or gas stream and then into the pipe.

BRIEF DESCRIPTION OF THE DRAWINGS

The embodiments of the present invention will now be described by reference to the following figures, in which identical reference numerals in different figures indicate identical elements and in which.

DETAILED DESCRIPTION OF THE INVENTION

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

The present invention consists of an improved system and method for dispensing abrasive particulate material into a stream of gas that is introduced into a pipe for the purpose of cleaning the internal pipe walls, as well as to prepare surfaces of the internal pipe circumference for the subsequent application of a protective coating or liner.

Figure 1:
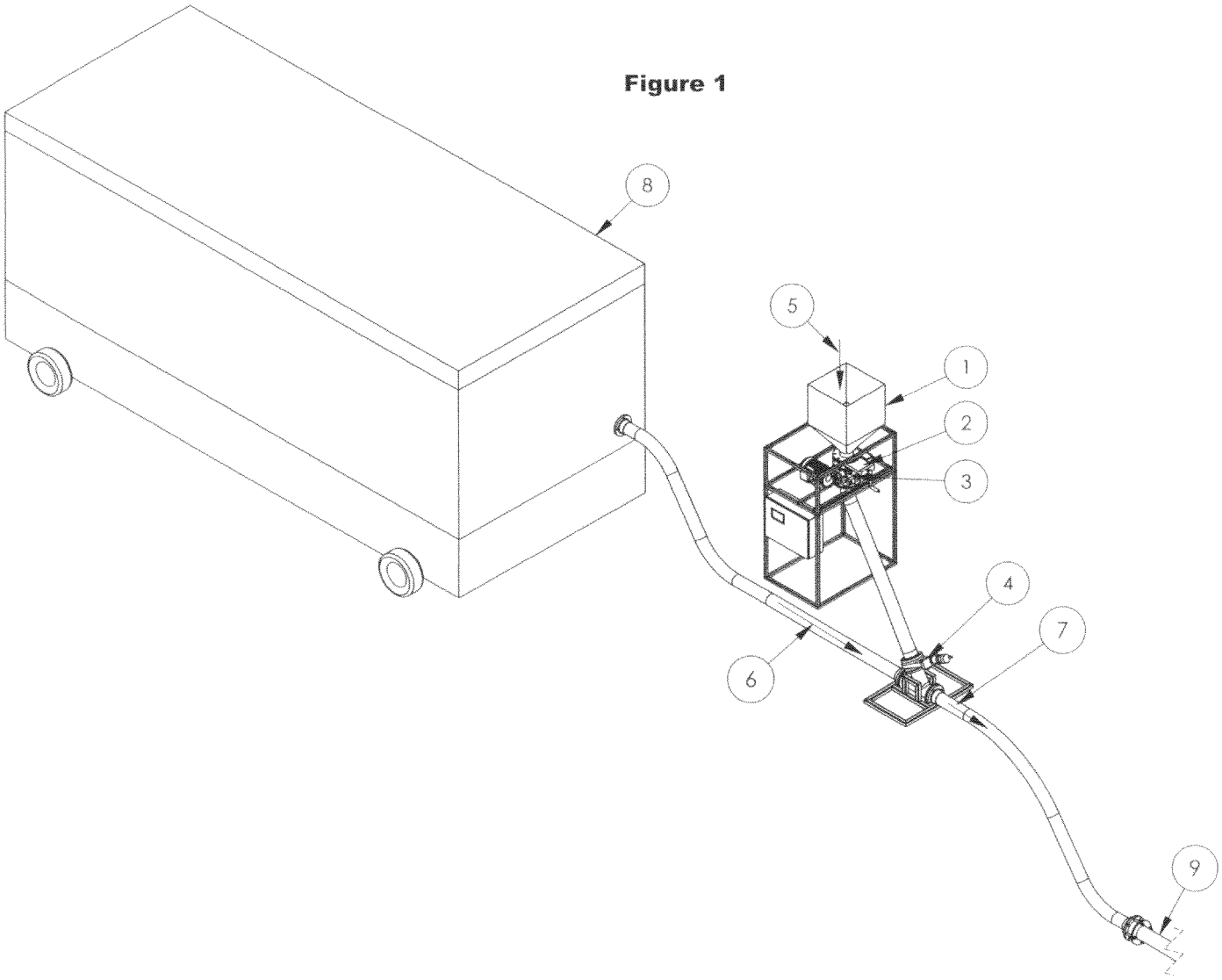
FIG. 1 is a perspective view of an embodiment of the system and method of the present invention.
Figure 2:
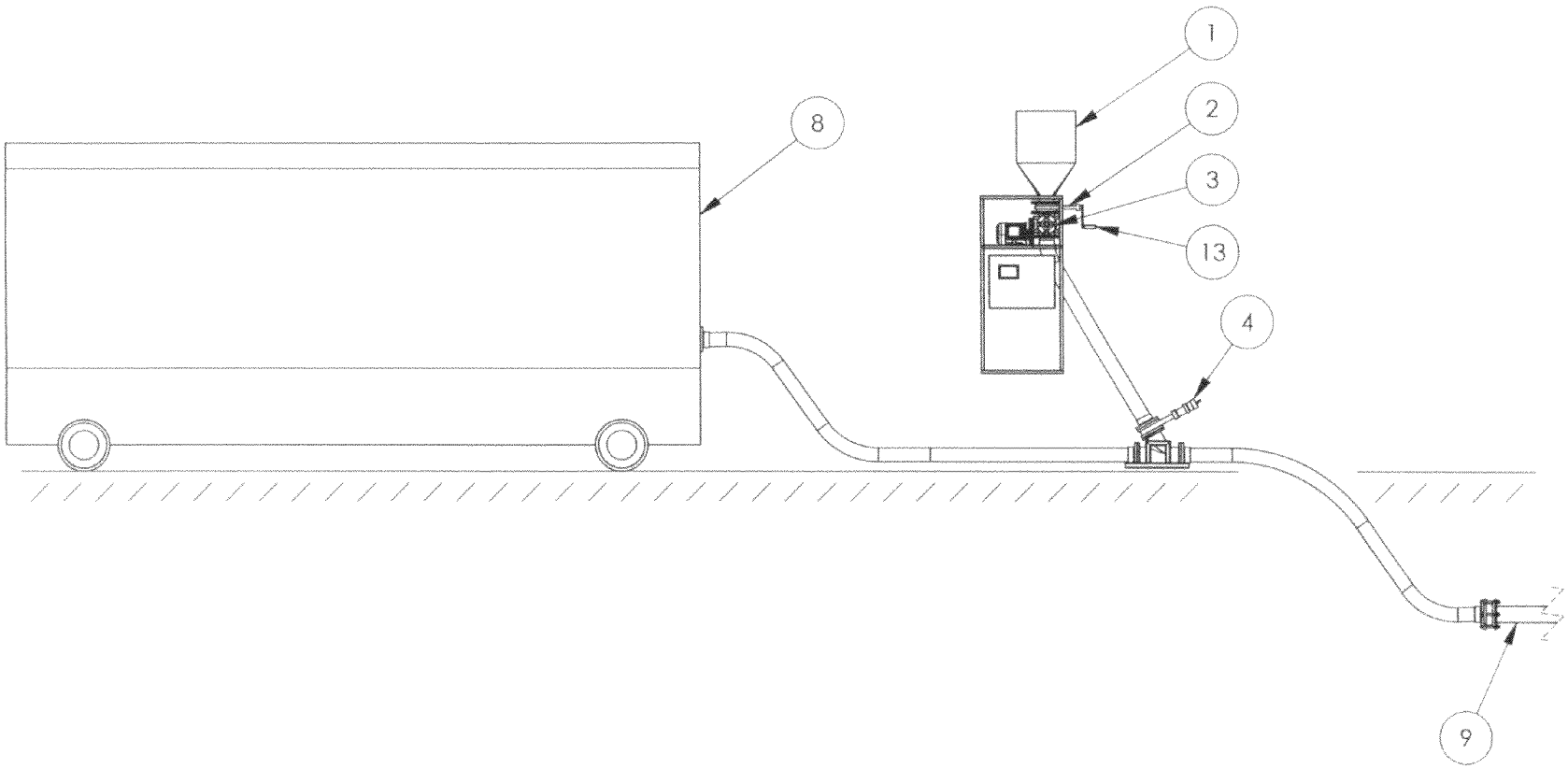
FIG. 2 is a side view of the embodiment of the system and method of the present invention shown in FIG. 1.

Referring to FIGS. 1 and 2, there is shown a first exemplary embodiment of the present invention. In a preferred embodiment, as hereinafter described, the system and method of the present invention comprises a hopper 1, a gate valve 2, a rotary airlock valve 3, a shut off valve 4, and an air blower/drier 8, as hereinafter described.

In operating the system of the present invention, in an exemplary embodiment, a target pipe section 9 is taken out of service and then accessed at either end of the pipe using dug pits. Once the pipe section 9 is opened and isolated, it is then drained and visually pre-inspected, such as through closed circuit television or a remote camera (not shown). As would be readily apparent to one skilled in the art, typically all service taps are opened so that they can back-drain into the pipe. The upstream and downstream in-service piping is then capped with protective, pressure sleeves (not shown). The target pipe section 9 is inspected to verify the extent of the contaminants and corrosion products that are present, although usually the extent of blockage can be pre-determined from service records.

Figure 3:
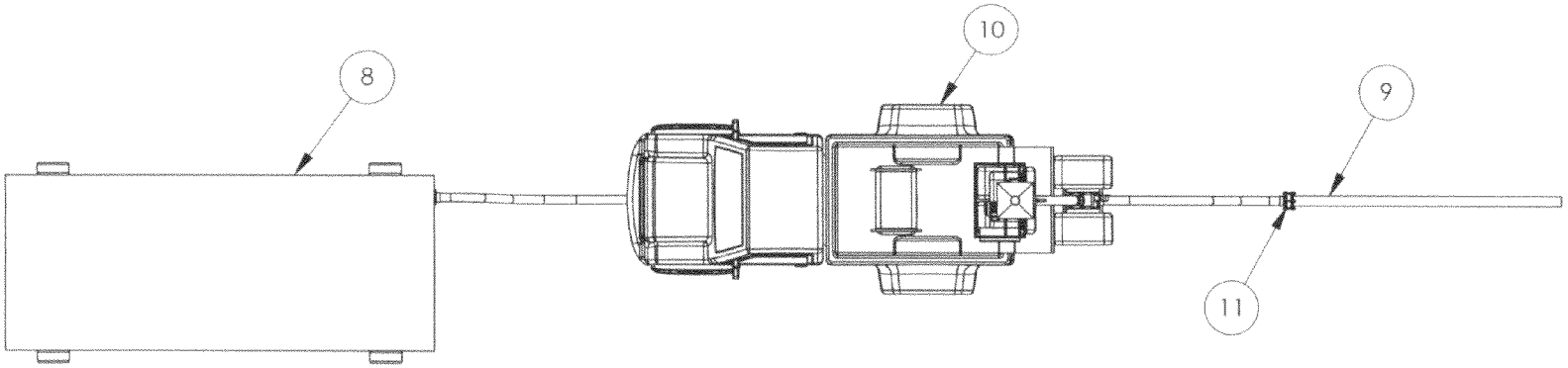
FIG. 3 is a top view of another embodiment of the system and method of the present invention.

An air blower/drier 8 is then coupled, by way of pressure-rated piping connections, to the isolated pipe section 9 at 11 (shown in FIGS. 3 and 4) and the air blower/drier 8 is used to clean out excess water and dry the in situ contaminants and corrosion products (e.g. tubercles) on the interior of the pipe section 9. It is conventionally thought that the application of high-volume, low-pressure, clean, heated air from the outset will speed drying and make the contaminants and corrosion products (not shown) more brittle/friable in preparation for the introduction of a selected grade/size of abrasive particulate material, as hereinafter described.

Figure 4:
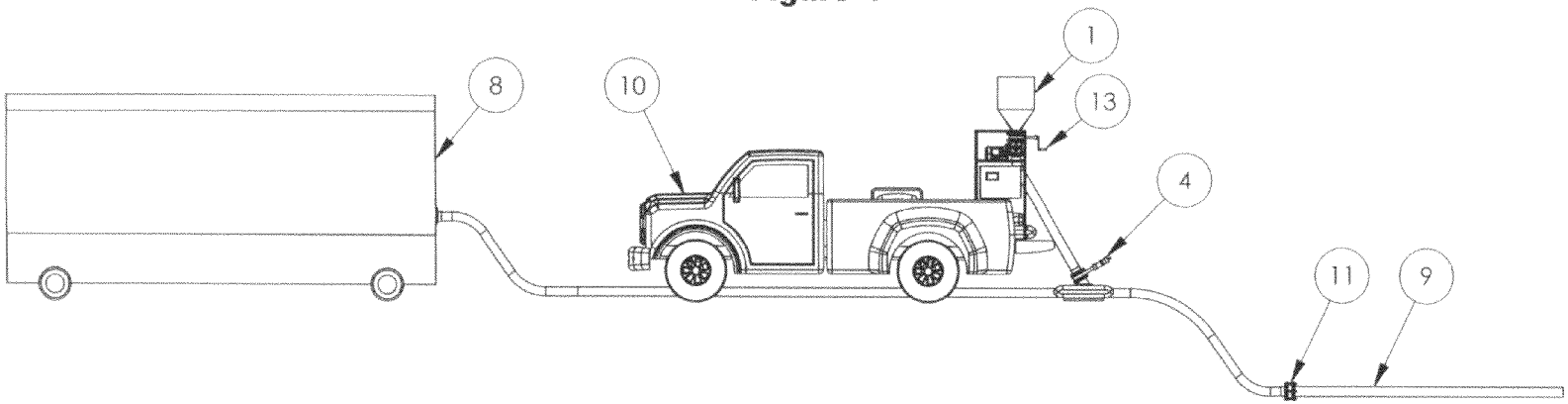
FIG. 4 is a side view of the embodiment of the system and method of the present invention shown in FIG. 3.

Once the pipe section 9 is suitably dry, the air blower/drier 8 is then de-energized and a suitably designed three component feeder assembly, comprised of a hopper 1, gate valve 2 and rotary air lock valve 3, and is connected at the upstream end of the pipe. In an exemplary embodiment, the feeder assembly is positioned between the air blower/drier 8 and the target pipe section 9 using a portable transport device such as a truck 10, as shown in FIGS. 1 and 2. Hopper 1 is not pressurized, as opposed to other conventional feed design systems, but rather is at atmospheric pressure. In this embodiment, such a feeder assembly comprised of hopper 1, gate valve 2 and rotary air lock 3 can be loaded onto a truck 10, as shown in FIG. 4, and moved about quite readily and easily.

The air blower/drier 8 is then energized so as to provide an air or gas stream (seen in FIG. 1 at 6), and suitable quantities of abrasive particulate materials (not shown) are progressively introduced into the hopper 1 at hopper opening 5 for later propulsion in a downstream flow 7 of the air or gas stream (as shown in FIG. 1). Examples of abrasive particulate material that could be used are flint, chert, granite, sand, rock, though it will be understood that numerous variations to these are possible, as would be readily apparent to one skilled in the art.

In an exemplary embodiment, the feeder assembly comprises hopper 1, gate valve 2 and a rotary air lock valve 3, which work in conjunction so as to allow the operator to meter out a selected quantity of abrasive particulate material from the hopper 1 to enter the air or gas stream 6 and be directed downstream 7 to the target pipe section 9', as hereinafter described.

During the start of the pipe cleaning process it is desirable not to "flood" or "choke" the pipe with too much abrasive particulate material and potentially create a blockage. As such, when beginning to progressively introduce abrasive particulate materials into the hopper 1, only a minimal amount of this material is first introduced, with the material that is introduced going to the bottom of the hopper 1 through gravity and first coming to contact with the gate valve 2 at the bottom of the hopper, which is fundamentally a slide gate through which the operator can initially regulate the amount of abrasive particulate materials that the rotary air lock valve 3 will be exposed to. When it is desired to add additional abrasive particulate material into the system, the operator turns handle 13, wherein the gate valve 2 slides horizontally to allow the abrasive particulate material to fall into the rotary air lock valve 3, which operates essentially as a sealed dispensing device, in that when a certain level of material accumulates, the rotary air lock valve can be rotated by the operator to introduce the abrasive particulate material downstream 7 (as shown in FIG. 1) to the pipe section 9. The gate valve 2 and the rotary air lock valve 3 could be hydraulically powered, if desired, or may be mechanically driven or driven by any other suitable means known to the skilled person. In an exemplary embodiment, not only does the rotary air lock valve 3 meter the amount of abrasive particulate material introduced, but it also, in doing so, moves this particulate material from atmospheric pressure into another pressurized air zone. Because of the tolerances and the number of vanes on the valve, there is a sealing effect from the inlet to the outlet side of the valve. Typically, this is in the range of between 15-40 pounds per square inch (psi), though variations to this will of course be possible.

In this manner, the operator is able to keep visual contact with and variable control of the introduction of abrasive particulate material into the air or gas stream 6 from hopper 1, rather than using a pressurized, enclosed feed screw, thus giving an operator better control of the dosing process into the pipe section 9 to be cleaned. Further, the operator can add more abrasive particulate material into the air or gas stream 6 as required or needed, without the need to de-energize the system or shut down, thus increasing the speed of the system in accomplishing the task. Moreover, the advantage of introducing abrasive particulate material through a rotating air-lock valve delivery such as that disclosed in the present invention, as opposed to a more conventional Archimedes axial-feed screw, is that the rotating air-lock valve acts as the pressure block while, by its design, an Archimedes axial-feed screw cannot. Hence, there is a need for such conventional, axial-feed screw systems and their supplies of abrasive particulate stone supply to be contained within a pressurized zone, such as a pressurized hopper, in order to function. Operators of such conventional axial-feed screw systems can achieve a good rate of control in introducing abrasive particulate matter into the system by screw rotation, but they cannot visually observe the dosing process. If there is a problem, or if the feed rate needs to be altered in any manner, the operator is limited to making adjustments by rotating the feed screw forwards or backwards to address these matters; otherwise, the feed system must be de-energized, thus slowing down the entire operation. By contrast, the present invention, by using gate valve 2 and rotary air lock valve 3 in conjunction with unpressurized hopper 1, the operator has two methods of feed control; visual contact with the feed process, and the ability to make adjustments without de-energizing the feed system, thereby realizing increasing operational efficiencies through decreased probability of system shut downs.

Once the abrasive particulate materials have been metered from the three-component feed system (hopper 1, gate valve 2 and rotary air lock valve 3) into air or gas stream 6 and downstream 7 (as shown in FIG. 1) to the pipe section 9, these charged abrasive particulate materials impact the contaminants and corrosion products on the interior of the pipe section 9 and remove them from the pipe walls. Of course, it will be understood that the downstream "receiving pit" (excavation) can be, before the air blower/drier 8 is energized, covered (at surface) to prevent or substantially inhibit any energized abrasive particulate materials from escaping the downstream excavation. Abrasive particulate, corrosion products, and dust can otherwise be collected in the "receiving pit" from pipe section 9 using conventional collection boxes and dust separators known to those skilled in this cleaning process.

In addition, the movement and action of the hardened, angular abrasive particulate materials also scrapes the internal walls of the pipe section 9, thereby providing a degree of surface preparation for a subsequently applied, protective coating or liner. The hot/warm/dry air that propels the abrasive also acts to heat the pipe to a temperature that will keep it dry and prevent condensation.

Once the cleaning process is completed, the upstream hardware (air blower/drier 8, three-component feed system comprising hopper 1, gate valve 2 and airlock valve 3 and connecting pipes) is de-energized, disconnected and removed from the upstream location. The target pipe section 9 is then ready for immediate coating or lining using a variety of methods including, for example, cement mortar, sprayed epoxy, sprayed advanced polymers (polyurethane or polyurea) or cured-in-place pipe lining, though it will be understood that numerous variations to this are possible, as would be readily apparent to one skilled in the art.

In an alternative embodiment, the system further comprises a shut off valve 4 (as shown in FIGS. 1, 2 and 4) and preferably is manually operated. The purpose of shut off valve 4 is to isolate the rotary airlock valve 3 from the system, when system troubleshooting or maintenance is required, or when higher pressures will be used to dry and cleanout the pipe. For example, when the air blower/drier 8 is to be used at higher pressures during the process of using the air blower/drier 8 to clean out excess water and dry the in situ contaminants and corrosion products, the air lock valve 3 can be isolated by engaging shut off valve 4, minimizing the potential for pressure loss out through the hopper 1 at these higher drying pressures. Similarly, by engaging shut off valve 4 anytime during feed system operation, blockage or feed problems with abrasive particulate can be quickly rectified without system shutdown.

It will be apparent to those skilled in this art that various modifications and variations may be made to the embodiments disclosed herein, consistent with the present invention, without departing from the spirit and scope of the present invention.

Other embodiments consistent with the present invention will become apparent from consideration of the specification and the practice of the invention disclosed therein.

Accordingly, the specification and the embodiments are to be considered exemplary only, with a true scope and spirit of the invention being disclosed by the following claims.

The embodiments of the invention in which an exclusive property or privilege is claimed are defined as follows:

1. A system for dispensing abrasive particulate material into a gas stream to be introduced into an in situ static pipe for simultaneous full length cleaning an interior of the in situ static pipe, comprising:

a) a blower statically coupled to a first end of the in situ static pipe, the blower blowing the gas stream at a pressure ranging between fifteen and thirty pounds per square inch throughout the full length of the in situ static pipe;

b) a hopper for dispensing an abrasive particulate material into the gas stream, the hopper being constructed and arranged for filling operation at atmospheric pressure and, the hopper further comprising a housing having an inlet for receiving the particulate material and an outlet for delivery of the particulate material from the hopper to a rotary gas lock valve, the rotary gas lock valve receiving the particulate material and delivering the particulate material from the hopper into the gas stream; and d) the hopper and rotary gas lock valve remaining external to the interior of the in situ static pipe;

whereas reloading of the hopper with the abrasive material is performed while the gas stream continues and the blower continues blowing the gas stream at the pressure ranging between fifteen and thirty pounds per square inch.

2. The system of claim 1, wherein, when the rotary gas lock valve is rotated to transport the particulate material into the gas stream, the particulate material being moved from atmospheric pressure into a pressurized air zone.

3. The system of claim 1, wherein the particulate material comprises at least one material selected from flint, chert, and granite.

4. The system of claim 1, wherein the system further comprises a shut off valve to selectively isolate the rotary gas lock valve from a remainder of the system.

5. The system of claim 4, wherein the shut off valve is manually operated.

6. The system of claim 1, further comprising, after the interior of the in situ static pipe has been cleaned, one of a protective coating and liner applied to the interior of the in situ static pipe.

7. The system of claim 1, wherein the hopper is positioned between the blower and the in situ static pipe to be cleaned.

8. A method of simultaneous full length cleaning of an interior of a static pipe in situ, said method comprising:

a) providing a continuous gas stream at a pressure ranging between fifteen and thirty pounds per square inch and connecting the continuous gas stream to a first end of the pipe to blow gas simultaneously throughout the pipe;

b) providing a static hopper at atmospheric pressure and in fluid communication with the continuous gas stream and the pipe;

c) providing a rotary gas lock valve positioned within the hopper, the rotary gas lock valve receiving abrasive material from the hopper and selectively delivering the abrasive material to the pipe and the blower, the rotary gas lock valve for regulating a flow of abrasive particulate material from the hopper to the continuous gas stream and the static pipe;

d) dispensing abrasive particulate material into the hopper;

e) selectively operating the rotary gas lock valve so as to transport the abrasive particulate material from the hopper into the continuous gas stream and the pipe; and f) adding additional abrasive particulate material to the hopper while the continuous gas stream continues uninterrupted and the continuous gas stream remains at the pressure ranging between fifteen and thirty pounds per square inch.

9. A method of simultaneous full length cleaning an interior of a static pipe section in situ, said method comprising:

a) isolating the static pipe section from other pipe sections;

b) streaming gas into the static pipe section to dry out the static pipe section to dry inner walls of the pipe;

c) stopping the streaming;

d) adding an abrasive material into a hopper, the hopper being at atmospheric pressure and in fluid communication with the static pipe section through a valve feed thereby contacting and regulating a flow of abrasive particulate material from the hopper to the static pipe section;

e) re-starting the streaming of the gas stream at a pressure ranging between fifteen and thirty pounds per square inch into the static pipe section;

f) introducing additional particulate material into the hopper while streaming of the gas stream into the static pipe section at the pressure ranging between fifteen and thirty pounds per square inch; and g) selectively operating the valve feed so as to transport the particulate material from the hopper into the gas stream and into the static pipe section.

10. The method of claim 9, further comprising a step of, after cleaning completion, applying at least one selected from a protective coating and liner to the interior of the static pipe section.

* * * * *